US008033894B2

(12) United States Patent
Yadid et al.

(10) Patent No.: US 8,033,894 B2
(45) Date of Patent: Oct. 11, 2011

(54) RAZOR BLADE SHARPENER AND METHOD OF SHARPENING

(76) Inventors: Menachem Yadid, Herzlia (IL); Sahar Zaydi, Shoham (IL)

( * ) Notice: Subject to any disclaimer, the term of this patent is extended or adjusted under 35 U.S.C. 154(b) by 0 days.

(21) Appl. No.: 12/589,415

(22) Filed: Oct. 22, 2009

(65) Prior Publication Data

US 2010/0068975 A1 Mar. 18, 2010

Related U.S. Application Data

(63) Continuation of application No. PCT/IL2009/000282, filed on Mar. 12, 2009.

(30) Foreign Application Priority Data

Mar. 12, 2008 (IL) ..... 190127

(51) Int. Cl.
*B24B 3/50* (2006.01)

(52) U.S. Cl. ..... 451/45; 451/224

(58) Field of Classification Search ..... 451/45, 451/224, 229; 76/82, 82.2
See application file for complete search history.

(56) References Cited

U.S. PATENT DOCUMENTS

| | | | | |
|---|---|---|---|---|
| 1,956,686 | A | 5/1934 | Kane | |
| 3,854,251 | A | 12/1974 | Paule | |
| 3,875,702 | A | 4/1975 | Yacos | |
| 3,979,857 | A | 9/1976 | Kobylarz | |
| 4,608,782 | A | 9/1986 | Chylinski | |
| 5,313,706 | A | 5/1994 | Motta et al. | |
| 5,958,134 | A | 9/1999 | Yasar et al. | |
| 6,506,106 | B2 * | 1/2003 | Fletcher | 451/293 |
| 6,969,299 | B1 * | 11/2005 | Papetti | 451/6 |
| 7,104,874 | B1 * | 9/2006 | Gussack et al. | 451/234 |
| 2005/0101231 | A1 * | 5/2005 | Sekerich | 451/234 |

* cited by examiner

*Primary Examiner* — Robert Rose
(74) *Attorney, Agent, or Firm* — Lipsitz & McAllister, LLC

(57) ABSTRACT

A device for sharpening razor blades, comprising, a housing having an upper casing and a lower casing defining an interior space, the upper casing having an opening, and a lid to cover the opening, a reciprocating carriage disposed in the lower case below the opening for receiving a razor blade unit containing a razor blade with a shaving edge facing downward, a sharpening wheel coated on its outer circumference with an abrasive material fixedly disposed in the lower case for rotation around an axis beneath and simultaneously with the reciprocating carriage, mechanism to reciprocate the carriage, mechanism to rotate the sharpening wheel, power supply to operate the reciprocating and rotating mechanisms, a switch to activate the device to reciprocate the carriage and rotate the sharpening wheel simultaneously, such that when the razor blade unit with the razor blade is inserted through the opening into the carriage and the power is turned on by the switch the sharpening wheel rotates and the carriage holding the razor blade reciprocates at the same time, with the shaving edge of the razor blade traversing the abrasive material on the outer circumference of the rotating sharpening wheel as the carriage moves in one direction thereby evenly sharpening the shaving edge of the razor blade, and when the carriage reciprocates in the other direction, the abrasive material on the rotating sharpening wheel re-contacts the razor blade to clean it of shaving residue.

15 Claims, 11 Drawing Sheets

RAZOR BLADE SHARPENER AND METHOD OF SHARPENING

This application is a continuation of international application no. PCT/IL2009/000282 filed on Mar. 12, 2009. This application claims the benefit of international application no. PCT/IL2009/000282 of Mar. 12, 2009 and Israeli patent application no. 190127 filed on Mar. 12, 2008, the entire contents of which are incorporated herein by reference.

FIELD OF THE INVENTION

The present invention relates to razor blade sharpeners, and more particularly, to a portable device and a method for sharpening multiple-razor blades in a razor blade unit.

BACKGROUND

Safety razors are found in almost every home in modern society. Most men and women have such razors for use in shaving unwanted body hair. The term "razor applies to the whole shaving device which usually consists of a handle either formed as a unit with a fixed blade head holding one or more razor blades, or a handle with a removable blade head.

Since razor blades are made from very thin, metallic material, they tend to wear out rather quickly. Thus these blades often need to be replaced at a not insignificant cost over a year's time. This also contributes to the pollution to the environment due to the non-biodegradable nature of the metal and plastic from which they are usually manufactured.

Attempts have been made to develop alternatives that will prolong the useful life of razors.

One approach is to provide blades with adjustable positioning, such as a pivoting blade arrangement described in U.S. Pat. No. 5,313,706, incorporated herein by reference.

Another approach is to sharpen used blades so that they can be reused repeatedly. This reduces the amount of pollution from discarding the used plastic and metal razor into the environment. Thus sharpeners to hone the dulled razor blade edges have come on the market.

U.S. Pat. No. 3,875,702 shows a mechanism for sharpening razor blades with two vibrating sharpening stones where the blade is rotated from one side to the other, each side being sharpened by a different stone.

U.S. Pat. No. 5,958,134 describes a process for cutting edges of stacks of razor blades by moving the stacks through deposition and etching stations mounted in the sides of a vacuum chamber.

U.S. Pat. No. 6,969,299 discloses a razor blade sharpener for multiple blades with a spring-loaded motorized belt having an abrasive material. The device has a razor cleaner, timer, and sensors. The belt is made to move horizontally across all the blade edges simultaneously and does not necessarily compensate for the angle of the blades. There is no provision for cleaning the edge of the blades to leave the razor free from the residue resulting from the abrasion process.

U.S. Pat. No. 7,104,874 claims a razor sharpening apparatus with a rotatable hub and at least one flexible sharpening strip with abrasive surface mounted on the hub for sharpening one or more blades. One end of the strip is mounted to the hub and the other end projects freely. When the hub is rotated the flexible strip sweeps across the blade to strop the blade edges only in one direction.

As the above cited examples show, there are blade sharpeners that generally operate in accordance with well-known principles to those who are skilled in the art. A light, abrasive force is applied against the edge of a razor blade using some kind of repetitive motion. For multiple razor blade heads, this can be a problem if the blades are not sharpened at the same angle and with the same force. This increases the likelihood of an uneven shave and some blades in multiple razor blade cassettes will be left more worn than others. Furthermore, there needs to be a way to remove fluff or metallic residue resulting from abrasion which invariably tends to collect on the cutting edges of sharpened razor blades and which may interfere with a good shave. The above-cited patents have one or more of these disadvantages which the present invention comes to resolve.

SUMMARY OF THE INVENTION

Accordingly, it is a broad object of the present invention to overcome the disadvantages and limitations of the prior art by providing a portable device for sharpening razor blades particularly in multiple razor blade units.

It is another object of the invention to provide an efficient and economical method for sharpening of razor blades particularly in multiple razor blade units.

It is yet another object of the present invention to provide a method for sharpening of multiple razor blades in razor blade units, wherein a reciprocating carriage moves the razor blades transversely across the surface of a rotating sharpening wheel coated with an abrasive so that each blade edge is uniformly and evenly sharpened to the same angle.

It is still another object of the invention is to provide a method for removing build-up unwanted residue and fuzz which may accumulate in minute quantities on the blades during sharpening.

Thus according to one aspect of the invention, there is provided a sharpening device for sharpening razor blades, comprising,

- a housing having an upper casing and a lower casing defining an interior space, the upper casing having an opening, and a lid to cover the opening,
- a reciprocating carriage disposed in the lower case below the opening for receiving a razor blade unit containing a razor blade with a shaving edge facing downward,
- a sharpening wheel coated on its outer circumference with an abrasive material fixedly disposed in the lower case for rotation around an axis beneath and simultaneously with the reciprocating carriage,
- mechanism to reciprocate the carriage,
- mechanism to rotate the sharpening wheel,
- power supply to operate the reciprocating and rotating mechanisms,
- a switch to activate the device to reciprocate the carriage and rotate the sharpening wheel simultaneously,
- such that when the razor blade unit with the razor blade is inserted through the opening into the carriage and the power is turned on by the switch the sharpening wheel rotates and the carriage holding the razor blade reciprocates at the same time, with the shaving edge of the razor blade traversing the abrasive material on the outer circumference of the rotating sharpening wheel as the carriage moves in one direction thereby evenly sharpening the shaving edge of the razor blade, and when the carriage reciprocates in the other direction, the abrasive material on the rotating sharpening wheel re-contacts the razor blade to clean it of shaving residue.

In a preferred embodiment, the carriage is disposed to receive a razor blade unit containing multiple razor blades held in a razor blade unit to give each blade an even, sharp edge at a uniform angle.

In one embodiment of the invention, the device further comprises a pressure pad mounted on the underside of the lid.

In another embodiment, the mechanism to reciprocate is a reciprocating motor.

In yet another embodiment, the reciprocating carriage is supported on and moves on parallel slider rods disposed horizontally inside the lower housing section.

In another embodiment, the rotating mechanism is a gear assembly activated by a motor.

The devices may be hand portable.

According to one preferred embodiment, the pressure pad is made of a rubber material.

The devices' power may be supplied by batteries.

The devices may comprise a reducing transformer wherein the power is supplied by an outside AC source.

According to another aspect of the invention, a method for sharpening at least one razor blade held in a razor blade unit is provided, comprising, providing a device comprising:

- a housing having an upper casing and a lower casing defining an interior space, the upper casing having an opening, and a lid to cover the opening,
- a reciprocating carriage disposed in the lower case below the opening for receiving a razor blade unit containing at least one razor blade with the shaving edges facing downward,
- a sharpening wheel coated on its outer circumference with an abrasive material fixedly disposed in the lowere case for rotation around an axis beneath and simultaneously with the reciprocating carriage,
- mechanism to reciprocate the carriage,
- mechanism to rotate the sharpening wheel,
- power supply to operate the reciprocating and rotating mechanisms, and
- a switch to activate the device to reciprocate the carriage and rotate the sharpening wheel simultaneously,
- inserting the razor blade unit with the at least one razor blades into the carriage of the device through the opening so that the shaving edges face downwards, turning on the power of the device to rotate the sharpening wheel with the coated abrasive material and reciprocate the carriage simultaneously, to hone the razor blade shaving edges when the carriage moves in one direction, and remove the shaving residues from the razor blade when the carriage moves in the opposite direction to give the blades even, sharp edges at a uniform angle, turning off the power and removing the razor blade unit with the sharpened razor blades.

The abrasive material on the sharpening wheel may comprise fine particles selected from at least one of the group of hard materials comprising: diamond chips and flint.

According to yet another aspect of the invention there is provided a kit comprising at least one razor blade unit comprising at least one razor blade, and any of the devices described above.

According to one embodiment of the invention, the razor blade unit in the kit comprises at least one razor blade with adjustable positioning.

According to one embodiment, the razor blade unit in the kit comprises at least one razor blade with a pivoting blade arrangement.

BRIEF DESCRIPTION OF THE DRAWINGS

For a better understanding of the invention with regard to the embodiments thereof, reference is made to the accompanying drawings, in which like numerals designate corresponding elements or sections throughout and wherein.

DETAILED DESCRIPTION OF THE INVENTION

Figure 1:
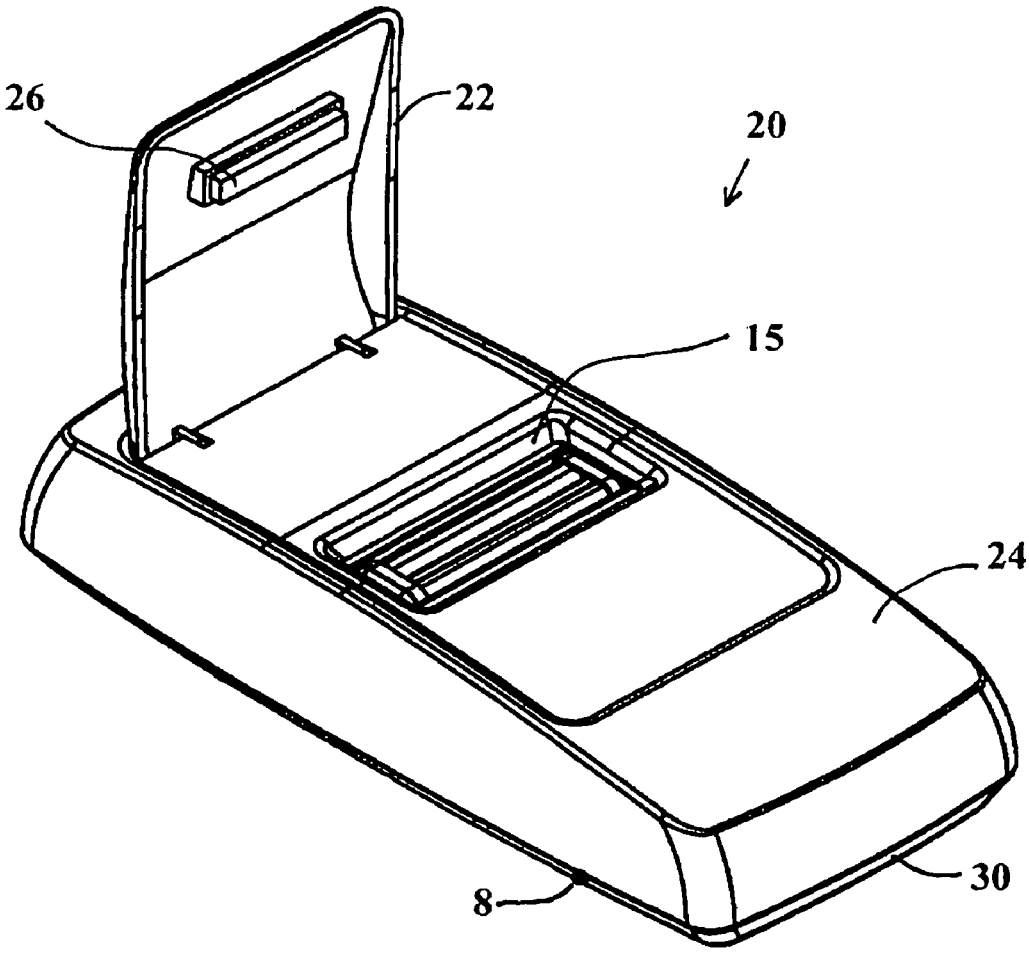
FIG. 1 illustrates a general isometric view of the device of the present invention in accordance with a preferred embodiment thereof.
Figure 2:
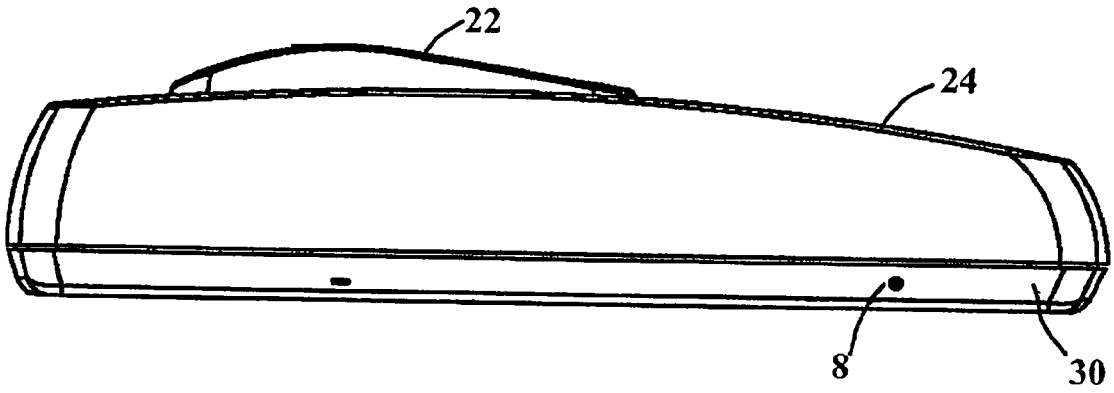
FIG. 2 shows a side view of the device from FIG. 1.
Figure 3:
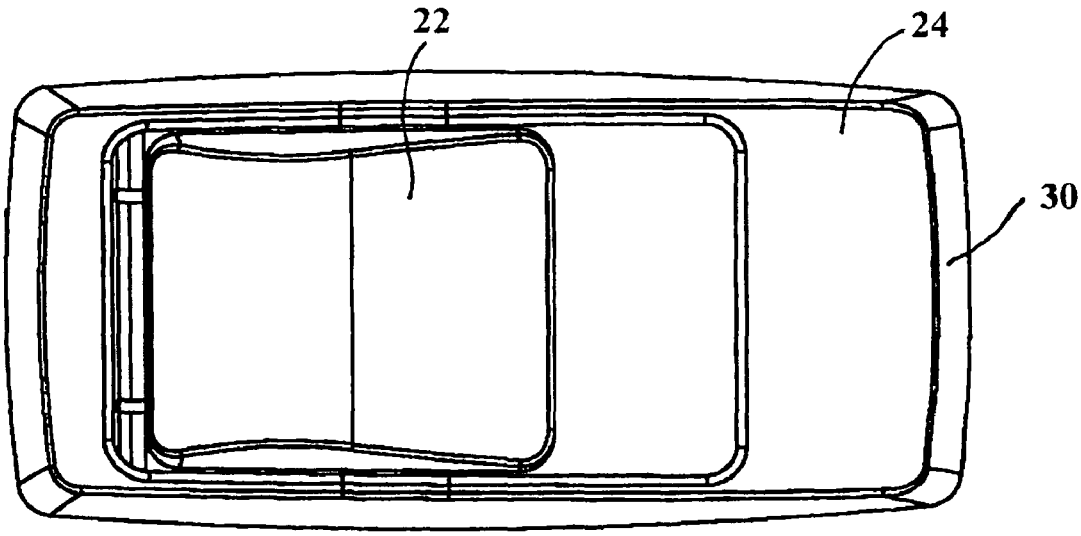
FIG. 3 is a top view if the device of FIG. 1.
Figure 4:
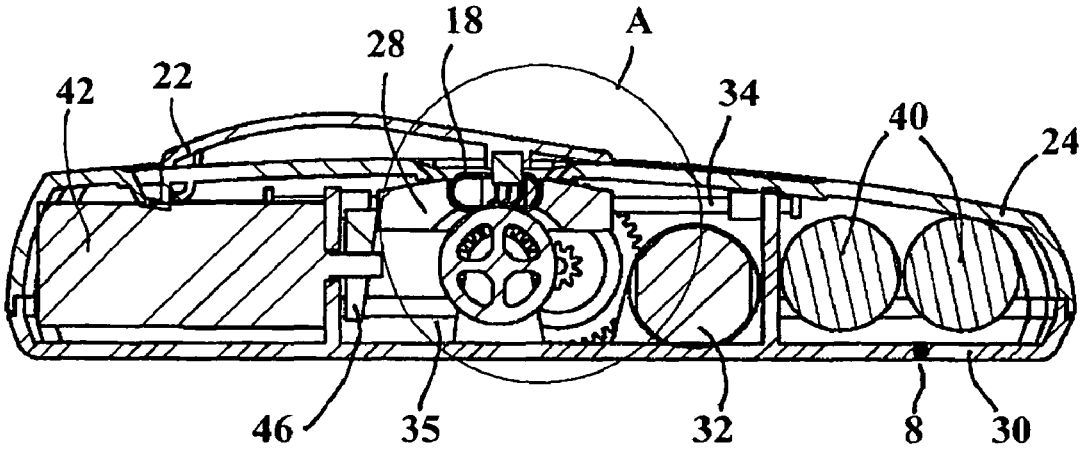
FIG. 4 is a cross-sectional view of the device of FIG. 2 showing the internal components in accordance with a preferred embodiment of the invention.

Referring to FIGS. 1 to 3, there are illustrated a general isometric, side and top view, respectively, of a portable battery operated device of the present invention in accordance with a preferred embodiment thereof. A razor-blade sharpener 20 is shown comprised of an upper casing 24 with an opening 15 and a lower casing 30 with a flat base to maintain a level position when placed on a flat surface which prevents unwanted motion while in operation. The upper housing sections 24 and lower housing section 30 snap fit together. The upper casing 24 has a flip lid 22 the under side of which contains a pressure pad 26 to apply a slight pressure to razor blade unit 18 (see FIG. 4) when inserted into the opening 15 above the carriage 28 for even sharpening of razor blades (see FIGS. 9*a*, 9*b* and 9*c*). A button switch 8 activates the power that operates the device. The upper housing section 24, the lid 22 and lower housing section 30 are preferably made of plastic.

Referring now to FIGS. 4 to 8, the device 20 comprises a sharpening wheel 35 mounted on an axis 60 supported by supports 48 (see FIG. 6) and sharpening wheel 35 is coated with an abrasive material 36. This wheel 35 is driven to rotate by a first motor 32 via gear array 37, 38, 39 (see FIGS. 5 and 8) powered by batteries 40. Alternatively or additionally power can be provided from an external AC electrical source with the use of a reducing transformer. A carriage 28 is supported on a pair of slider rods 34 which allow it freedom of movement to transverse sharpening wheel 35. The supporting rods 34 are held in partitions 15 and secured with couplers 46 and screw caps 50. A second motor 42 rotates wedge shaped biased wheel 46 that impels the carriage 28 to reciprocate along rods 34 for sharpening whichever razor blade 11, 12, 14 is brought in close proximity to the tangent of wheel 35 and contacts abrasive material 36. A resilient rubber pressure pad 26 applies pressure on the heads of the razor blades 10, 12 14 to maintain them in a fixed position. On repeated passes of the reciprocating carriage 28 over abrasive material 36, each razor blade 10, 12, 14 is in a position to be individually sharpened when the carriage travels in one direction and then cleaned of unwanted burrs or fuzz caused by the sharpening process when the carriage travels back in the other direction.

Figure 5:
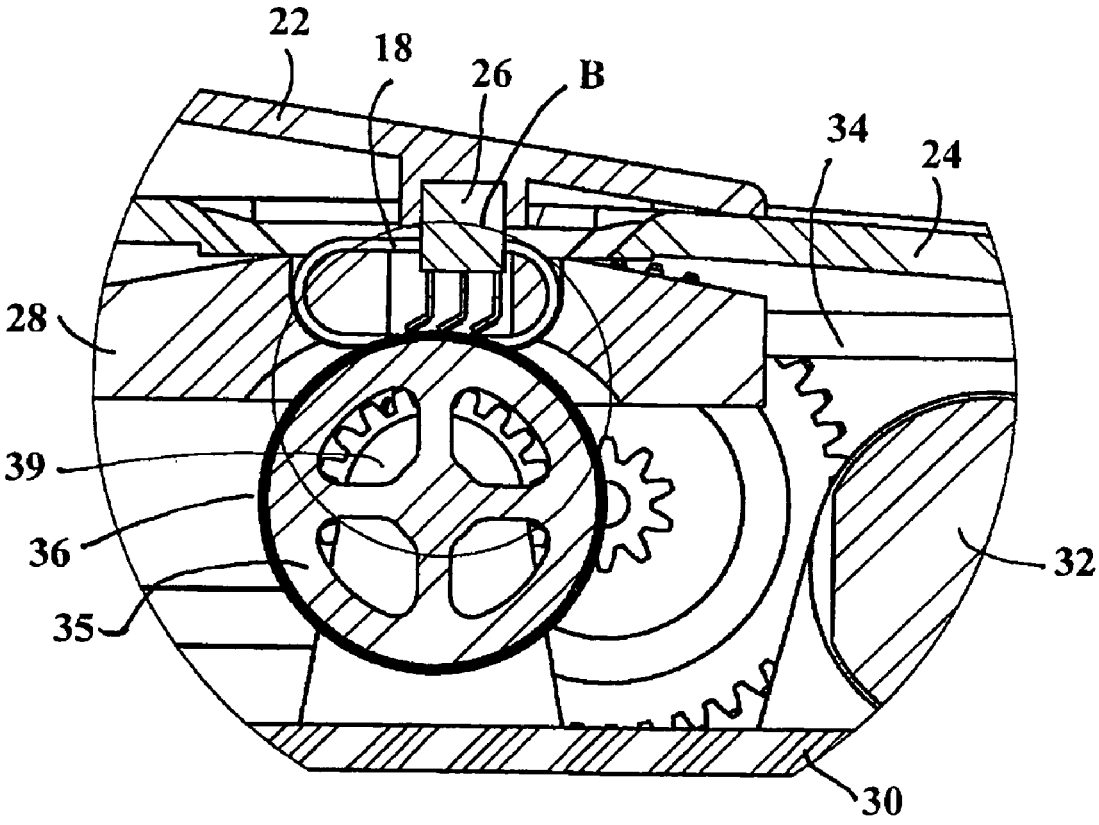
FIG. 5 is an enlarged view of Detail A from FIG. 4.
Figure 6:
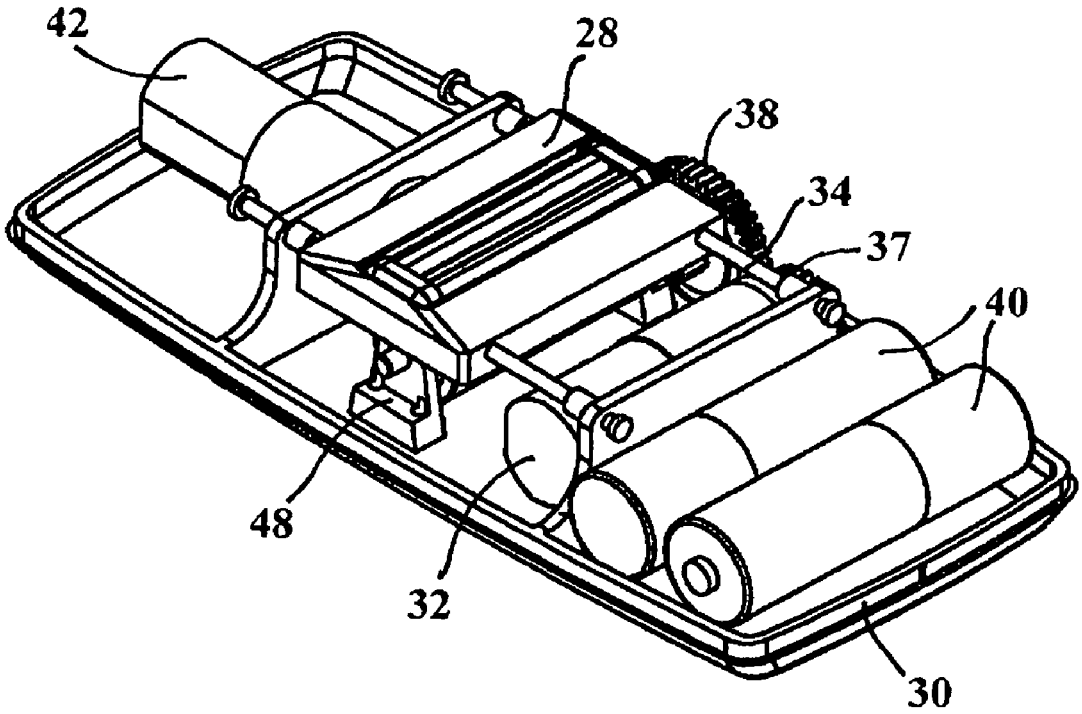
FIG. 6 is an isometric view of the internal components of the device of FIG. 1 with the upper casing removed.
Figure 7:
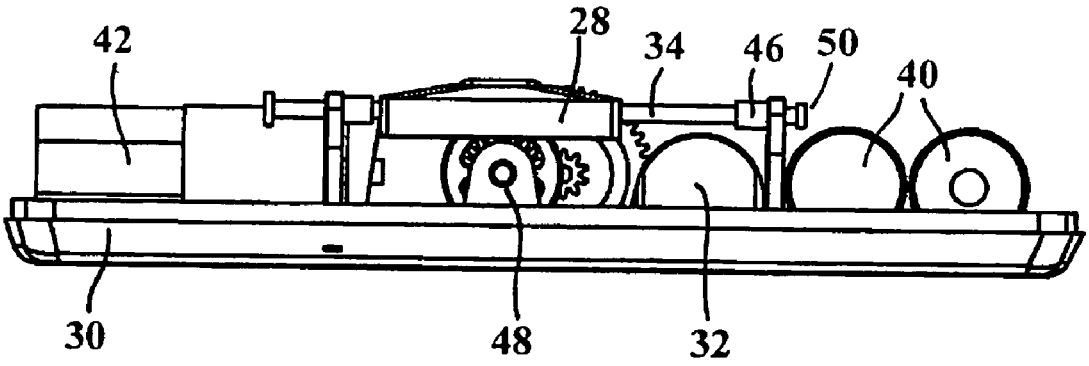
FIG. 7 is a side view of the device as in FIG. 2 with the upper casing removed.
Figure 8:
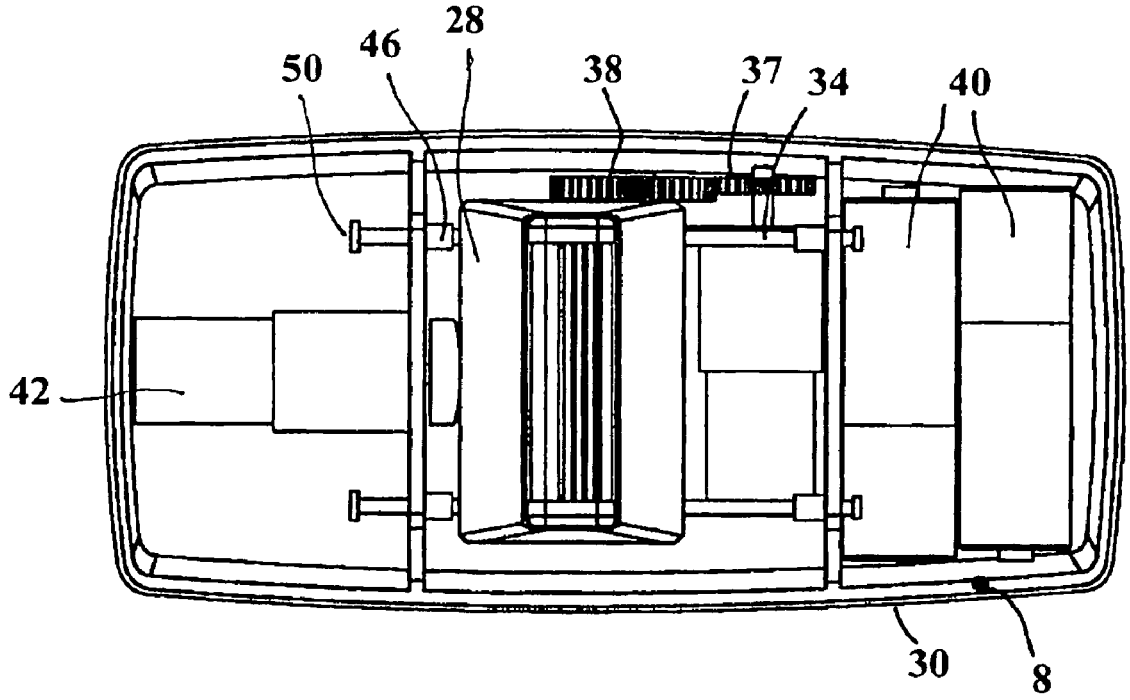
FIG. 8 is a top view of the device shown in FIG. 3 with the upper casing removed showing the layout and relationship of internal components to one another.
Figure 9A:
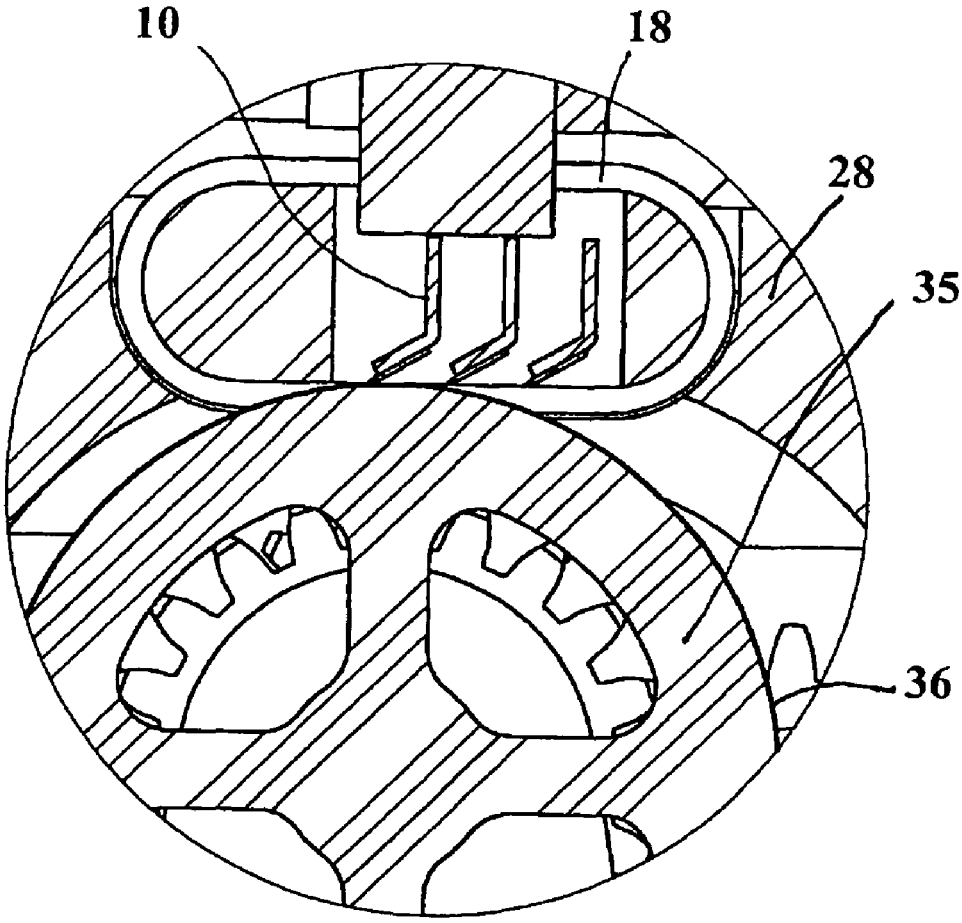
FIGS. 9*a*, 9*b*, and 9*c* are enlarged views of Detail B from FIG. 5 illustrating the sharpening of three razor blades in a razor blade unit.
Figure 9B:
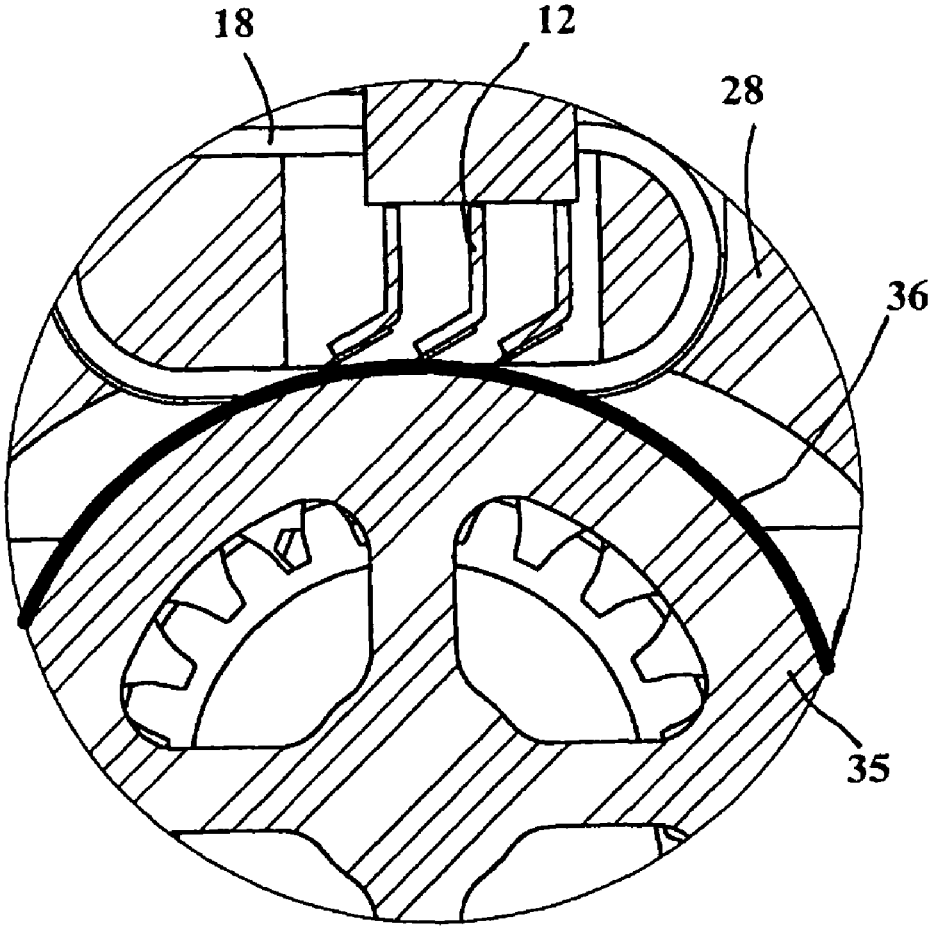
Figure 9C:
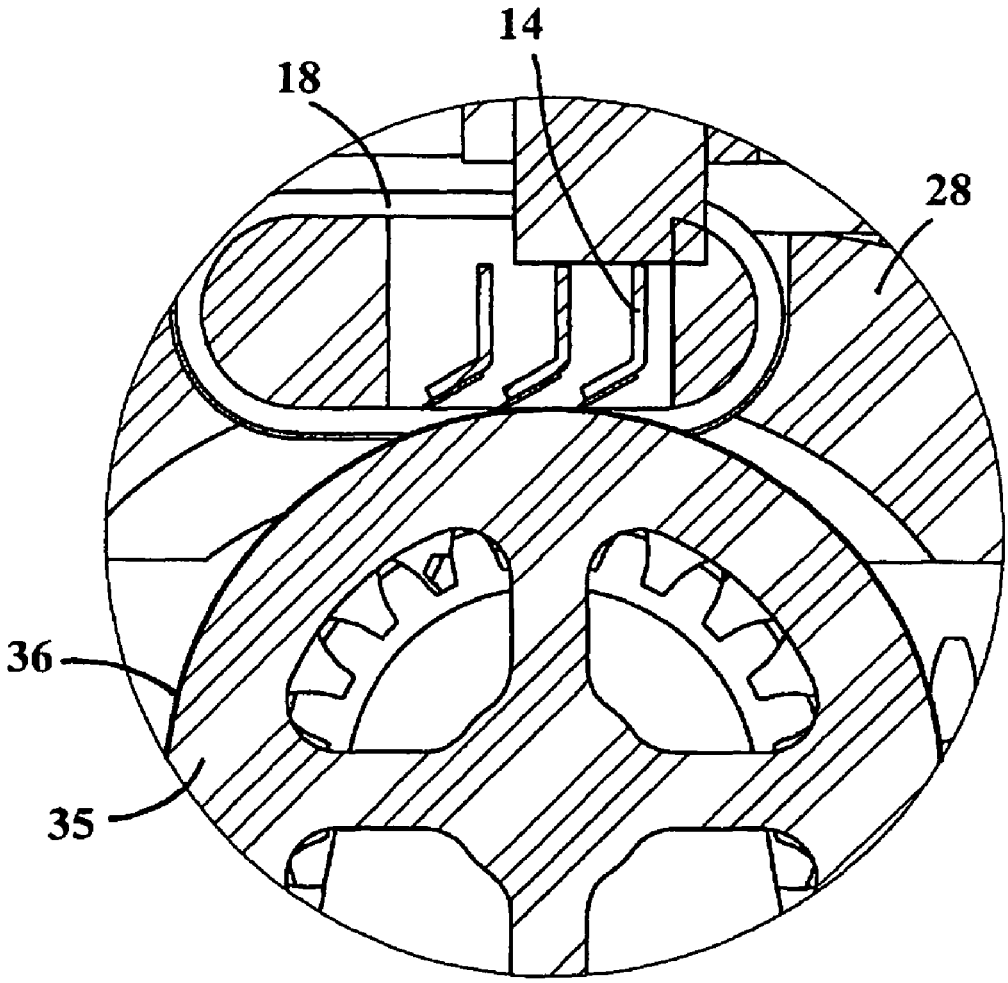

FIGS. 9*a*, 9*b*, and 9*c* are enlarged views of Detail B in FIG. 5 illustrating the method of the present invention for sharpening razor blades in a typical multiple razor blade unit, by way of example, comprising three blades. FIG. 9*a* shows blade 10 in position for sharpening; FIG. 9*b* shows blade 12 in position for sharpening; and FIG. 9*c* shows blade 14 in position for sharpening. The multiple razor blades 10, 12, 14 remain stationary within unit 18 and only the carriage 28 moves transversely over sharpening wheel 35 to bring each blade 10, 12, 14 in individual contact with abrasive material 36 so as to advantageously give each blade an even, sharp edge at a uniform angle as well as remove fuzz or any residue remaining on the blades after being sharpened upon the reverse movement of the carriage 28.

Having described the present invention with regard to certain specific embodiments thereof, it is to be understood that the description is not meant as a limitation, since further modifications may now suggest themselves to those skilled in the art, and it is intended to cover such modifications as fall within the scope of the claims of the described invention.

What is claimed is:

1. A device for sharpening razor blades, comprising, a housing having an upper casing and a lower casing defining an interior space, the upper casing having an opening, and a lid to cover the opening, a reciprocating carriage disposed in the lower casing below the opening for receiving a razor blade unit containing a razor blade with a shaving edge facing downward, a sharpening wheel coated on its outer circumference with an abrasive material, the sharpening wheel being fixedly disposed in the lower casing beneath the reciprocating carriage for rotation around an axis simultaneously with the reciprocating carriage, a mechanism to reciprocate the carriage, a mechanism to rotate the sharpening wheel, a power supply to operate the reciprocating and rotating mechanisms, a switch to activate the device to reciprocate the carriage and rotate the sharpening wheel simultaneously, wherein when the razor blade unit with the razor blade is inserted through the opening into the carriage and power is turned on by the switch, the sharpening wheel rotates and the carriage holding the razor blade reciprocates at the same time, with the shaving edge of the razor blade traversing the abrasive material on the outer circumference of the rotating sharpening wheel as the carriage moves in one direction thereby evenly sharpening the shaving edge of the razor blade, and when the carriage reciprocates in the other direction, the abrasive material on the rotating sharpening wheel re-contacts the razor blade to clean the razor blade of shaving residue.

2. A device as in claim 1, wherein the carriage is disposed to receive a razor blade unit containing multiple razor blades held in a razor blade unit to give each blade an even, sharp edge at a uniform angle.

3. A device for sharpening razor blades in accordance with claim 2, further comprising a pressure pad mounted on the underside of the lid.

4. A device in accordance with claim 2, wherein the mechanism to reciprocate is a reciprocating motor.

5. A device in accordance with claim 2 wherein the reciprocating carriage is supported on and moves on parallel slider rods disposed horizontally inside the lower housing section.

6. A device in accordance with claim 2, wherein the rotating mechanism is a gear assembly activated by a motor.

7. A device in accordance with claim 2, wherein the device is hand portable.

8. A device in accordance with claim 3, wherein pressure pad is made of a rubber material.

9. A device in accordance with claim 2, wherein the power is supplied by batteries.

10. A device as in claim 2, further comprising a reducing transformer, wherein the power is supplied by an outside AC source.

11. A method for sharpening at least one razor blade held in a razor blade unit, comprising, providing a device comprising:

a housing having an upper casing and a lower casing defining an interior space, the upper casing having an opening, and a lid to cover the opening, a reciprocating carriage disposed in the lower casing below the opening for receiving a razor blade unit containing at least one razor blade with a shaving edge facing downward, a sharpening wheel coated on its outer circumference with an abrasive material, the sharpening wheel being fixedly disposed in the lower casing beneath the reciprocating carriage for rotation around an axis simultaneously with the reciprocating carriage, a mechanism to reciprocate the carriage, a mechanism to rotate the sharpening wheel, a power supply to operate the reciprocating and rotating mechanisms, and a switch to activate the device to reciprocate the carriage and rotate the sharpening wheel simultaneously, inserting the razor blade unit with the at least one razor blade into the carriage of the device through the opening so that the shaving edge faces downwards, turning on power of the device to rotate the sharpening wheel with the coated abrasive material and reciprocate the carriage simultaneously, to hone the at least one razor blade shaving edge when the carriage moves in one direction, and remove the shaving residues from the at least one razor blade when the carriage moves in the opposite direction to give the at least one razor blade even, sharp edges at a uniform angle, turning off the power and removing the razor blade unit with the at least one sharpened razor blade.

12. The method as in claim 11 wherein the abrasive material comprises fine particles selected from at least one of the group of hard materials comprising: diamond chips and flint.

13. A kit comprising a razor blade unit comprising at least one razor blade, and a device for sharpening razor blades of claim 1.

14. The kit of claim 13, wherein the razor blade unit comprises at least one razor blade with adjustable positioning.

15. The kit of claim 13, wherein the razor blade unit comprises at least one razor blade with a pivoting blade arrangement.

* * * * *